US008294567B1

(12) United States Patent
Stell

(10) Patent No.: US 8,294,567 B1
(45) **Date of Patent: *Oct. 23, 2012**

(54) METHOD AND SYSTEM FOR FIRE DETECTION

(75) Inventor: Andrew W Stell, Aledo, TX (US)

(73) Assignee: Williams-Pyro, Inc., Fort Worth, TX (US)

( * ) Notice: Subject to any disclaimer, the term of this patent is extended or adjusted under 35 U.S.C. 154(b) by 2 days.

This patent is subject to a terminal disclaimer.

(21) Appl. No.: 13/084,796

(22) Filed: Apr. 12, 2011

Related U.S. Application Data

(63) Continuation of application No. 12/184,724, filed on Aug. 1, 2008, now Pat. No. 7,969,296.

(51) Int. Cl.
*G08B 19/00* (2006.01)
*G08B 17/10* (2006.01)

(52) U.S. Cl. ..... 340/522; 340/628

(58) Field of Classification Search ..... 340/539.22, 340/539.24, 539.26, 539.27, 517, 521, 522, 340/577, 628–630, 584; 706/2, 4
See application file for complete search history.

(56) References Cited

U.S. PATENT DOCUMENTS

| | | | | |
|---|---|---|---|---|
| 5,518,075 | A | 5/1996 | Williams | |
| 5,691,703 | A * | 11/1997 | Roby et al. | 340/628 |
| 5,966,079 | A | 10/1999 | Tanguay | |
| 6,029,751 | A | 2/2000 | Ford et al. | |
| 6,107,925 | A | 8/2000 | Wong | |
| 6,121,883 | A * | 9/2000 | Hatsir | 340/584 |
| 6,392,536 | B1 | 5/2002 | Tice et al. | |
| 7,142,105 | B2 | 11/2006 | Chen | |
| 7,170,418 | B2 | 1/2007 | Rose-Pehrsson et al. | |
| 7,182,143 | B2 | 2/2007 | Hall et al. | |
| 7,286,704 | B2 | 10/2007 | Pfefferseder et al. | |
| 2004/0145466 | A1 | 7/2004 | Anthony et al. | |

* cited by examiner

*Primary Examiner* — Jennifer Mehmood
(74) *Attorney, Agent, or Firm* — Morani Patent Law, PC

(57) ABSTRACT

A method and system are provided, which provides reliable fire detection. In one implementation, the automated system includes a combination of sensors configured to measure various factors associated with a hazard, such as a fire or gas leakage, and generate sensor readings. Factors measured can include smoke, carbon monoxide and heat. The system further includes a detection device that is configured to determine whether a hazard or fire exists by performing a fuzzy analysis of sensor readings. The fuzzy analysis includes categorizing respective sensor readings into fuzzy sets, and determining whether the hazard exists based on a combination of the categorizations. In addition the size and direction of a fire can be determined from multiple sensors.

19 Claims, 8 Drawing Sheets

| Fuzzy Set | Low Value | Center Value | High Value |
|---|---|---|---|
| Temperature Null (Degrees K) | 0 | 300 | 315 |
| Temperature Alert (Degrees K) | 315 | 318 | 325 |
| Temperature Alarm (Degrees K) | 320 | 328 | 500 |
| CO Null (ppm) | 0 | a | 0.1 |
| CO Alert (ppm) | 40 | 70 | 85 |
| CO Alarm (ppm) | 80 | 100 | 2000 |
| Smoke Null (% obscuration) | 0 | 2% | 5% |
| Smoke Alert 1 (% obscuration) | 4% | 5% | 8% |
| Smoke Alert2 (% obscuration) | 8% | 10% | 18% |
| Smoke Alarm (% obscuration) | 15% | 20% | 100% |

602 604 606 608

Fig. 6

METHOD AND SYSTEM FOR FIRE DETECTION

CROSS REFERENCE TO RELATED APPLICATION

The present application is a Continuation of U.S. patent application Ser. No. 12/184,724, filed Aug. 1, 2008, the entire contents of which are incorporated by reference.

STATEMENT REGARDING FEDERALLY SPONSORED RESEARCH OR DEVELOPMENT

This invention was made with government support contract between the National Institute of Standards and Technology (NIST) and Williams-Pyro, Inc., Contract No. NIST, SB1341-03-C-0034. The government has certain rights in the invention.

BACKGROUND OF THE INVENTION

The present invention relates generally to smoke and carbon monoxide detectors. More particularly, the present invention relates to an improved fire detection system.

Fire detectors are commonly used for detecting a fire incident on a particular premise, to include residential and business premises. Commonly used fire detectors are either smoke detectors or temperature sensors. Typically, smoke detectors detect smoke, and cause an alarm to sound in case a fire is detected so that the premises can be evacuated as early as possible or so that other measures can be taken. Smoke detectors are commonly photoelectric or ionization type detectors. The photoelectric sensors use a chamber with a light emitting diode (LED) light source and a photodetector. The photodetector is usually mounted at right angles from the light source. When smoke enters the chamber, the light from the LED is scattered, causing some of the light from the LED source to be sensed by the detector. When the detected light level reaches a set point, an alarm sounds to alert the occupants of the building.

Typically, ionization sensors may contain a small amount of radioactive material in a chamber. When smoke enters the chamber, the radiation from the chamber ionizes the smoke particles, causing the chamber to conduct electric current. The current is measured by a sensing circuit. When the smoke concentration reaches a set point, an alarm sounds to warn observers of the potential hazard.

While these sensors may efficiently detect a fire in some situations, in other situations and other types of fires, the detection may be inadequate. For example, when there is a slow, smoldering fire, the photoelectric type smoke sensor provides faster detection than the ionization type smoke sensor. On the other hand, when there is a fast, open-flame fire, the ionization sensor provides faster detection than the photoelectric type smoke sensor. In addition, these sensors, at times, raise false alarms due to the detection of steam, aerosol spray, and smoke from nuisance smoke sources such as a stovetop, fireplaces, and microwaved products. Some other sensors include features, such as time delay to confirm the presence of fire. Still other conventional fire detectors allow a user to turn off a sounding alarm at the user's discretion.

Still other conventional fire detectors, use temperature sensors to assess the presence of a fire. Fire detectors based on temperature sensors typically measure the rate of increase of temperature in a particular area and raise an alarm if the temperature rise rate is greater than or equal to a threshold rise rate, where temperature rise rate of approximately 15 degrees Fahrenheit per minute (° F./min) is conventionally used. The rate of rise sensor is susceptible to delayed detection of fire.

Conventional detectors are susceptible to false alarms, nuisance alarms, and may be ineffective at early detection depending on the fire type. Improvements in fire detection are desirable to provide efficient, reliable, accurate, and early fire detection.

Further, a fire sensing method that reduces false alarms and provides early detection for many fires and many types of fires is desirable.

SUMMARY OF THE INVENTION

The present invention provides a system and method for fire detection addressing one or more of the issues presented above. This summary is provided to introduce concepts related to an automated system for fire detection, which is further described below in the detailed description. This summary is not intended to identify essential features of the claimed subject matter, nor is it intended for use in determining the scope of the claimed subject matter.

One aspect of the present invention is to provide accurate fire detection.

Another aspect of the present invention is to combine sensors to provide an optimum fire detection system and to detect size and direction of a fire.

Another aspect of the present invention is to provide a combination of different sensor types to provide efficient fire detection.

Another aspect of the present invention is an automated system which includes a combination of sensors configured to measure various attributes associated with a hazardous condition, such as a fire or gas leakage, and generate sensor readings.

The system further includes a detection device that is configured to determine whether the hazardous condition, or fire, exists by performing a fuzzy analysis of the sensor readings. A classifier module, neural network based classifier, classifies the sensory data. The inference module determines whether the hazard exists based on a combination of the categorizations.

Yet another aspect of the present invention is to provide an ability to differentiate between fires and nuisance sources.

Yet another aspect of the present invention is to operate when some sensors have failed.

Another aspect of the present invention is to operate with or without CO sensors, where the lack of CO sensors lowers system cost. Yet another aspect of the present invention is to provide quick, early, fire detection.

Those skilled in the art will further appreciate the above-noted features and advantages of the invention together with other important aspects thereof upon reading the detailed description that follows in conjunction with the drawings.

BRIEF DESCRIPTION OF THE FIGURES

The detailed description is provided with reference to the accompanying drawings. For more complete understanding of the features and advantages of the present invention, reference is now made to the detailed description of the invention along with the accompanying drawings, wherein:

FIG. 6 shows exemplary fuzzy sets for different sensor inputs, in accordance with an exemplary embodiment of the present invention;

DETAILED DESCRIPTION OF THE INVENTION

The invention, as defined by the claims, may be better understood by reference to the following detailed description. The description is meant to be read with reference to the figures contained herein. The specific aspects and embodiments discussed herein are merely illustrative of ways to make and use the invention, and do not limit the scope of the invention. The specific aspects, embodiments, and examples discussed herein are merely illustrative of ways to make and use the invention, and do not limit the scope of the invention.

Figure 1:
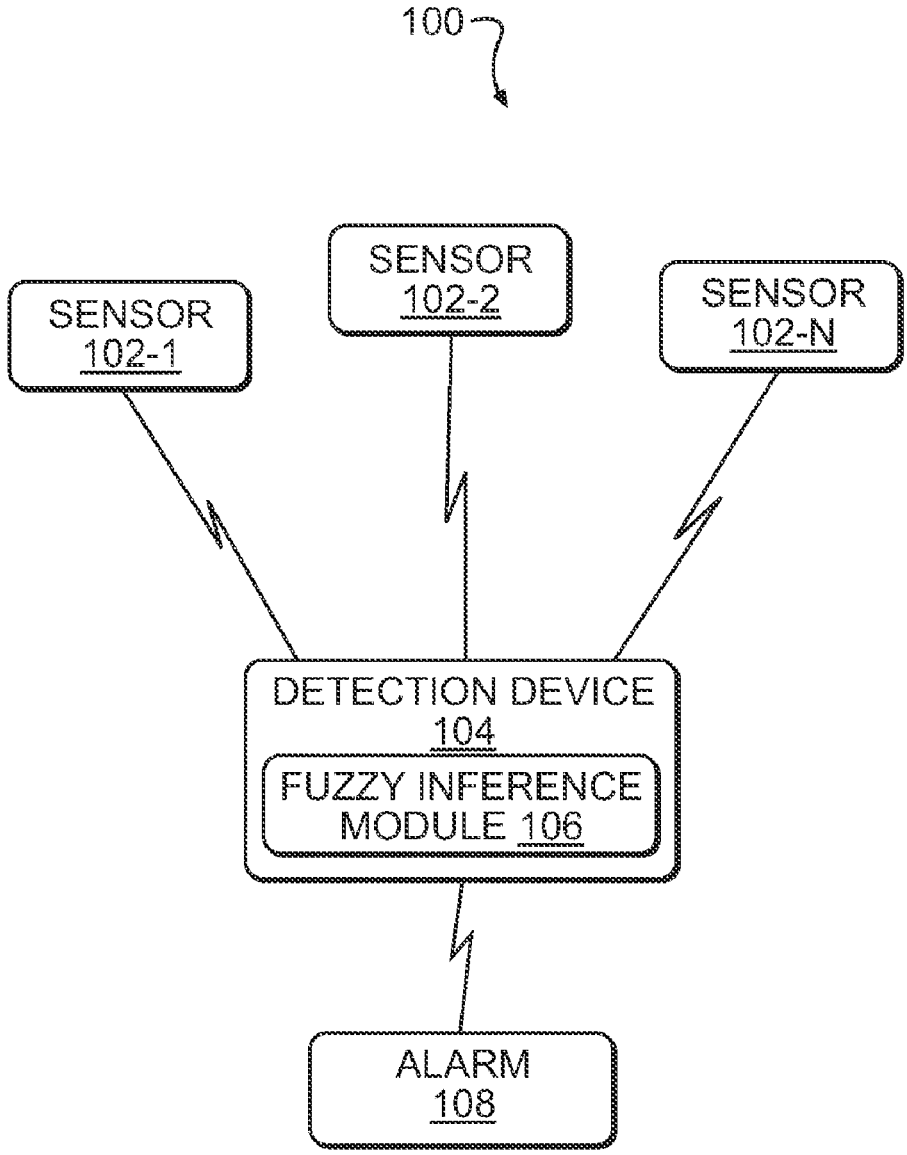
FIG. 1 shows an exemplary architecture of a fire detection system, in accordance with an exemplary embodiment of the present invention.

The system and method in accordance with the present invention may provide an accurate fire detection with decreased latency of detection. The disclosed techniques relate to implementing an automated fire detection system based on a detection device, also referred to as device, which uses a combination of sensors. The sensors detect one or more attributes of that can indicate a fire, such as smoke, carbon monoxide (CO), temperature, etc. Based on inputs received from the sensors, the device can detect various types of fires that may occur in a premises. The device is also configured to determine whether a supposed fire situation is an actual fire situation, and raise an alarm on the detection of an actual fire. The present invention system can reduce the number of false fire alarms. In one embodiment, the invention uses a mixture of sensors, which can enhance accuracy and speed as compared to the use of conventional smoke detectors. A block diagram of the invention is shown in FIG. 1.

The system includes a combination of sensors, which may be selected from, for example, temperature, infrared, smoke, any gas sensor, and rate of change of temperature. Sensors used in accordance with the present invention can be designed to be used alone to detect a fire, to work in combination with other sensors to detect a fire, or not even be specifically designed for a fire detections system. The device, in accordance with the present invention, can analyze a number of inputs received from the combination of sensors using fuzzy inference to determine if a fire condition is present and accordingly raise an alarm or provide alternate appropriate feedback and response.

In one implementation of the system, a temperature sensor measures and stores temperature readings for a particular location over a particular time range. The device receives the readings and assigns a classification value to the temperature variation observed in the particular time range. Based on a fuzzy analysis of the classified value and the temperature readings, the device determines whether the temperature variation corresponds to an actual fire situation or not.

Though the above system has been discussed in the context of fire detection, it will be understood that a similar system having a plurality of sensors and a detection device that analyses inputs received from the plurality of sensors using fuzzy inference, can be used to detect other hazardous conditions as well. For example, leakage of toxic gases can be detected using sensors that can measure levels of various toxic fumes, and a detection device that uses fuzzy analysis to determine the seriousness of gas leakage. Using a system and method in accordance with the present invention a hazardous situation can be identified before a fire starts.

While aspects of described systems and methods for the fire detection system can be implemented in any number of different computing systems, environments, and configurations, embodiments of a fire detection are described in the context of the following exemplary system architectures.

FIG. 1 illustrates an exemplary system 100 for detection of fire. The system 100 includes one or more sensors 102-1, 102-2 . . . 102-N, collectively referred to as sensors 102 hereinafter. The sensors 102 are programmed or installed to sense inputs related to various potential attributes of a fire, fire indicators, or hazards and send the inputs to a detection device 104. The detection device 104 includes a fuzzy inference module 106 that determines whether there is a fire or not. On detection of a fire, the detection device 104 causes an alarm 108 to sound an alarm signal. While in still other embodiments, alternate feedback is provided in lieu of a audible alarm, or in addition to an audible alarm. The alarm condition can trigger various system responses and is not limited to sounding an alarm. Such a system 100 can detect different types of fires, for example, gasoline fire, paper fire, wood fire, etc., with a low probability of raising false alarms.

The sensors 102 may include, but are not limited to, sensors for detecting attributes such as temperature, smoke concentration, and infrared radiation. In addition, the sensors 102 may also include gas sensors such as CO sensors, and sensors for detecting other fumes. A sensor is a physical device that measures physical quantities such as, for example, heat, temperature, pressure, and smoke concentration. A sensor can convert the measured physical quantities into signals that can be analyzed for a higher probability of accurate detection of a fire situation, in accordance with the present invention.

In one embodiment, one of the sensors 102, such as the sensor 102-1, can be a temperature sensor that measures the temperature of a particular location. The sensor 102-1 can measure the temperature in any known unit such as degree Fahrenheit or Celsius. Typically, temperature sensors detect a fire by determining a large change in temperature, such as 15° F./min, which is likely to be due to heat released from a fire. However, this may result in latent detection of the fire, which is delayed past the desirable detection time. It can also give rise to false alarms if there is a sudden momentary increase in temperature near the sensor.

In the present embodiment, the sensor 102-1 measures the temperature at a predetermined frequency, such as twice in a minute, and simultaneously stores measured readings as data. The stored data can be sent to the detection device 104 at another predetermined frequency, such as every five minutes, or at the same frequency as acquisition of sensor data. The detection device 104 uses a neural network based classifier, which is described in detail later with reference to FIGS. 2 to 4*b*, to classify temperature rise rates.

Temperature rise rates are classified in a range, such as between 0 and 1, by the neural network based classifier. For example, readings corresponding to low rise rates of temperature can be classified with low scores. The classification details are sent to a fuzzy inference module 106, along with the temperature readings. The fuzzy inference module 106 then determines whether the temperature readings and the associated temperature rise classification values correspond to a fire or hazard condition.

In addition, or in other embodiments, the sensors 102 can include one or more of smoke sensors, infrared sensors, CO sensors, etc., which may also send their respective readings to the fuzzy inference module 106 of the detection device 104. The readings obtained can be, for example, smoke concentration values measured in terms of, for example, percent obscuration or amount of carbon monoxide measured in terms of parts per million (ppm).

In one case, in accordance with an exemplary embodiment, the sensor 102-2 can be an ionization smoke sensor. In such a case, the sensor 102-2 converts a measured analog voltage value into a digital value. The sensor 102-2 can use drift compensation methods in the conversion to negate the effects of dust in the atmosphere and dust accumulated in the chamber. The output of the sensor 102-2 is then sent to the fuzzy inference module 106 to determine whether there is a fire or not.

In another case, the sensor 102-3 can be a CO sensor. Typical CO sensors cause an alarm to be raised after CO concentrations of 70 ppm have been measured for one hour or more. Detecting concentrations as low as 20 ppm can lead to early detection of a fire, but may cause false alarms as well. In accordance with embodiments of the present invention, a heated tin oxide element can be used in the CO sensor to measure CO concentrations as low as 20 ppm. The measured concentrations are sent to the fuzzy inference module 106, which then analyzes the concentration levels to categorize them into different potential fire significance levels, promoting a reduction in false alarms.

In one implementation, in accordance with an exemplary embodiment, the neural network based classifier in the detection device 104 can classify readings received from smoke sensors, infrared sensors, CO sensors, and temperature sensors. These classification details are also sent to the fuzzy inference module 106. In another implementation, the readings from the sensors 102 can be directly sent to the fuzzy inference module 106 without classification.

The fuzzy inference module 106 categorizes inputs received from the neural network based classifier and/or the sensors 102 into fuzzy sets. The fuzzy set categories can be, for example, fast, medium, slow, alert, alarm, or null, each of which corresponds to a range of values in which an input can lie. The fuzzy inference module 106 takes into account a combination of the categories assigned to the inputs to determine whether there is a fire or not. Based on the determination, the detection device 104 can trigger the alarm 108 to alert the occupants of the particular location in case of a fire. In still other embodiments, an additional or substitute feedback is provided in response to a detected hazard, for example, the main power may shut off, sprinklers may activate, and doors may close.

Figure 2:
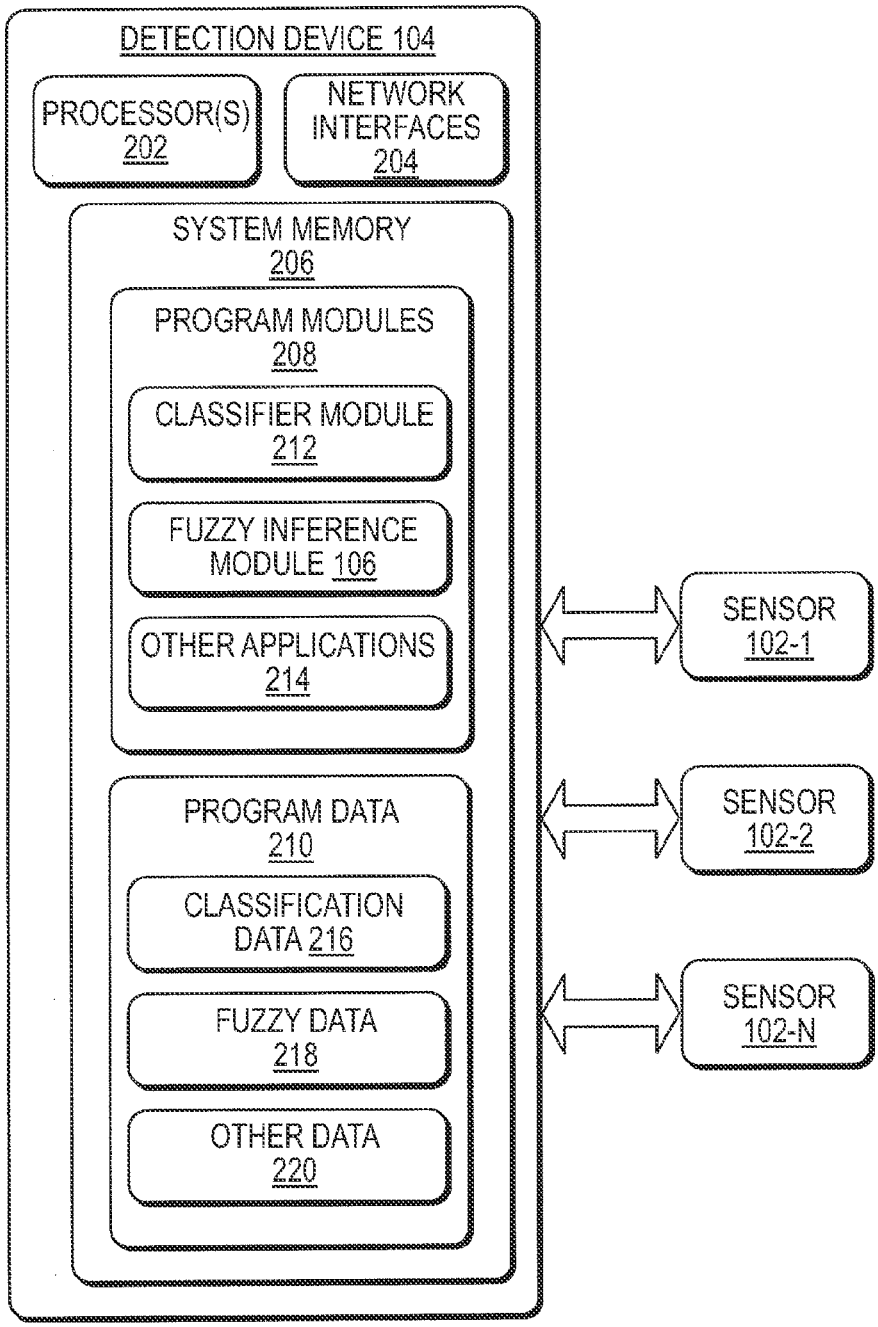
FIG. 2 shows an exemplary device in the exemplary fire detection system, in accordance with an exemplary embodiment of the present invention.

FIG. 2 illustrates an exemplary detection device 104 in a fire detection system 100 configured to do any of store, process, and analyze data from a plurality of sensors. The detection device 104 includes one or more processors 202, network interfaces 204, and memory 206. A processor or processors 202 can include, for example, microprocessors, microcomputers, microcontrollers, signal processors, central processing units, state machines, logic circuits, or any device that manipulates signals based on operational instructions. Among other capabilities, processors 202 are configured to fetch and execute computer-readable instructions stored in the memory 206.

The memory 206 may be any computer-readable storage medium, for example, volatile memory, random access memory (RAM), non-volatile memory, read only memory (ROM), or flash memory. The memory 206 may also include program modules 208 and program data 210. The program modules 208 further include a classifier module 212, a fuzzy inference module 106, and other applications 214. The program data 210 includes classification data 216, fuzzy data 218, and other data 220. The other data 220 may include supporting data corresponding to other applications 214.

In operation, the classifier module 212 receives signals or readings related to one or more fire attributes, such as temperature, smoke concentration, and carbon monoxide level, from the sensors 102 and assigns classification values to the readings. The classification values indicate the probability of the readings corresponding to a fire situation, or hazard. In one scenario, the classifier module 212 can receive readings periodically from one or more of the sensors 102. In another embodiment, the classifier module 212 can extract relevant information from the sensors 102 at predetermined time intervals, for example, after every five minutes.

The classifier module 212 can be a trained multi-layer perceptron neural network based classifier. In one implementation, in an embodiment in accordance with the present invention, the classifier module 212 receives temperature readings from a temperature sensor, such as the sensor 102-1. The classifier module 212 determines the temperature rise rate over a given time interval, such as over the last three minutes, and classifies the temperature rise rate using a temperature curve neural network. The classifier module assigns a score or classification value between 0 and 1 to the temperature rise rate. In an alternate embodiment, the classifier module receives data of temperature rise rate form and direct classification can be performed. A low score corresponds to a low rise rate and indicates a low probability of fire, while a high score corresponds to a high rise rate and indicates a high probability of fire. The classification values are stored in the classification data 216.

The fuzzy inference module 106 receives the sensor readings and classification values as inputs. As indicated above, the fuzzy inference module 106 categorizes the inputs values into fuzzy sets, and based on a combination of the categorizations, the fuzzy inference module 106 determines whether there is a fire or not. Subsequently, detection device 104 triggers an alarm 108 if a fire is determined to be present, in accordance with one exemplary embodiment. In an alternate embodiment, an alternate response is triggered on the finding of a fire condition.

In one implementation, fuzzy module 106 categorizes temperature rise rates into any one of four fuzzy sets based on the classification value assigned by the classifier module 212. The four fuzzy sets can be "null," corresponding to a flat or negative temperature rise, "slow", "medium", and "fast." The fuzzy set categorization is stored in the fuzzy data 218 for further use.

Similarly, sensor readings from the sensors 102, such as temperature readings, percentage obscuration readings due to smoke, CO concentration readings, etc., are classified into fuzzy sets by the fuzzy inference module 106, which are stored in the fuzzy data 218. The fuzzy categories used can include "null", "alert", "alarm", "caution," or other used desired categories.

Furthermore, the fuzzy inference module 106 can combine all the fuzzy set categorizations stored in the fuzzy data 218 to determine whether a fire has broken out or not. For this, the fuzzy module 106 can assign an output value of zero in case of "no fire", 1 in case of "possible incipient fire", and 2 in case of "fire" on combining the fuzzy set categorizations. Further, if the output value comes out to be 2, then the fuzzy module 106 sends a signal to ring the alarm 108, or to trigger alternate feedback, or to trigger both an alarm and additional measures.

In another implementation, the fuzzy module 106 can be used to determine the direction or location of a detected fire. In this embodiment, a plurality of temperature sensors can be used and the approximate direction of a fire can be identified by comparing the temperature rise rates determined from two or more temperature sensors placed at opposite ends or in different quadrants of the fire detector system 100. The temperature sensors with the fastest rise rate may be considered to be facing in the direction of the fire.

In addition, the relative size of a fire may be estimated by measuring and recording the temperature rise over the life of the incident. For example, the total rise in temperature from the initial ambient temperature at the start of the fire to a maximum temperature may be used to estimate the maximum size of the fire. As yet another example, the state of the fire with respect to size can be estimated by measuring the temperature rise and rise rate from inception to the time of instigating counter measures. Also, a probable source of the fire can be identified based on the temperature rise rate. For example, a gasoline fire shows a much higher temperature rise rate than a paper fire as the gasoline fire releases more heat than the paper fire.

Figure 8:
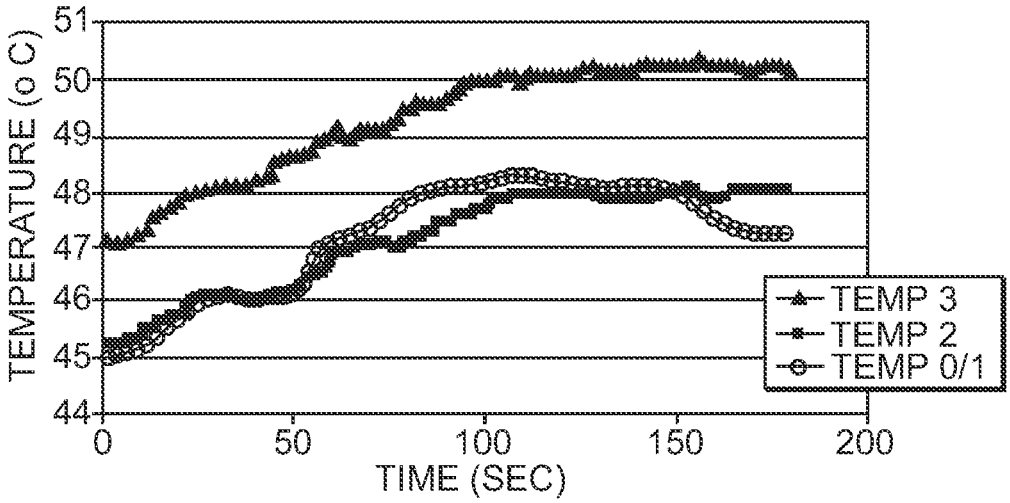
FIG. 8 shows exemplary results of an embodiment of the present invention comprising multiple temperature sensors during a paper fire.
Figure 9:
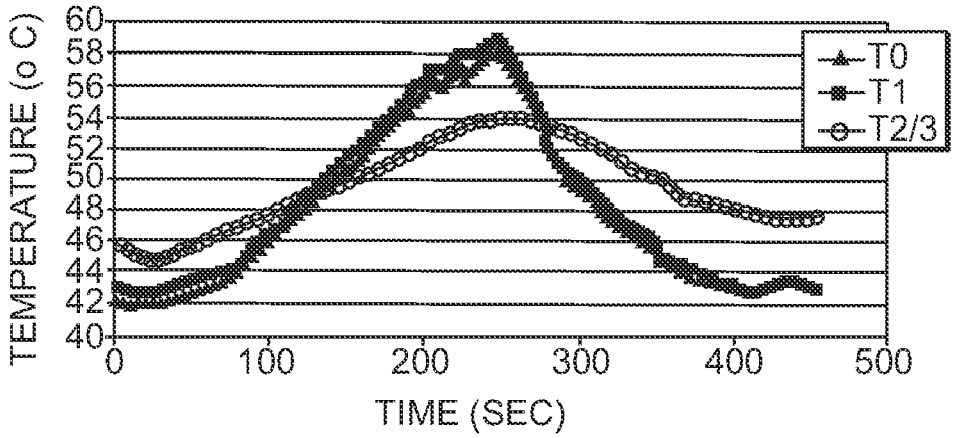
FIG. 9 shows exemplary results of an embodiment of the present invention comprising multiple temperature sensors during a gasoline fire.

Because temperature sensors are inexpensive, it is possible to determine the approximate direction of a fire by comparing the rise rates of two sensors placed at opposite ends or at quadrants on the fire detector. The temperature sensor with the fastest rise rate may be considered to be facing in the direction of the fire. FIGS. 8 and 9 show the results of temperature recordings from multiple sensors, in accordance with an exemplary embodiment of the present invention, during actual fires. As can be seen from FIG. 9, Temp0 and Temp1, corresponding to two discrete temperature sensors, recorded a faster temperature rise as compared with remaining temperature records from other temperature sensors, Temp2/3. These two recordings came from temperature sensors that were facing the fire. FIGS. 8 and 9 confirm detection of type of fire or size of fire. The relative size of a fire may be estimated by measuring and recording the ultimate temperature rise, from the initial ambient temperature at the start of the fire. FIG. 9 show a much higher temperature rise for the gasoline fire than for the paper fire of FIG. 8, indicating the gasoline fire released more heat than the paper fire. In FIG. 8, sensors Temp0 and Temp1 recorded overlapping values and are shown as one set of symbols, Temp0/1 for this scale, while in FIG. 9, sensors for Temp2 and Temp3 overlap and are shown as one set of symbols Temp2/3 for clarity.

Figure 3:
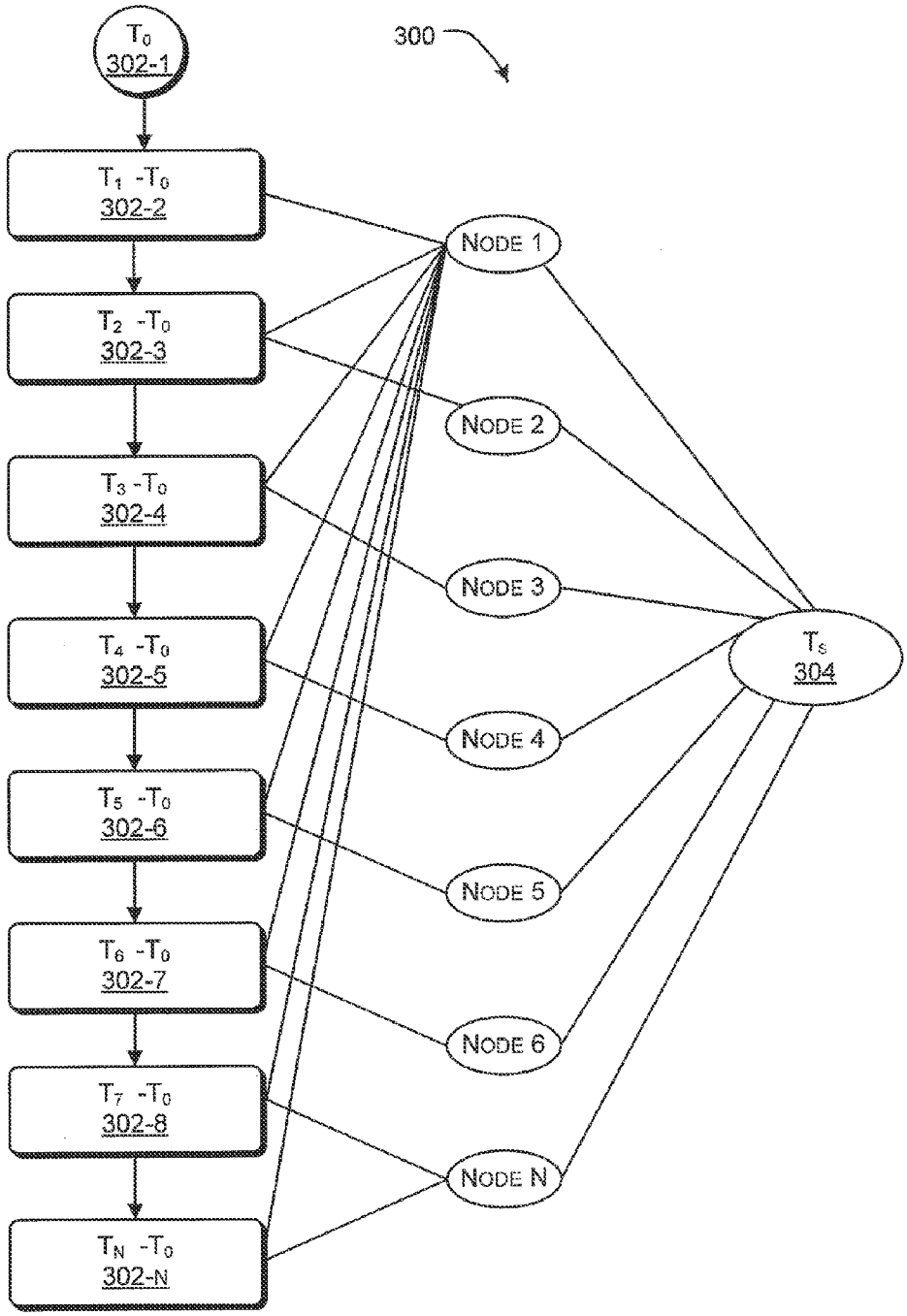
FIG. 3 shows an exemplary temperature classifier neural network, in accordance with an exemplary embodiment of the present invention.

FIG. 3 is an exemplary multilayer perceptron neural network 300 used by the classifier module 212. The neural network 300 can be a computational model. As known in the art, a neural network includes three layers of configuration namely an input layer, a hidden layer, and an output layer configuration. The neural network is an adaptive system that includes both external output and internal input information flowing through the network during the learning phase. The internal and the external information can be related to different criteria indicating a fire, for example, temperature, smoke concentration, or carbon monoxide concentration.

In one implementation, the neural network can be used for classifying temperature rise rates using a temperature curve. The input layer 300 in FIG. 3 corresponds to different temperature rise readings received by a temperature sensor, such as the sensor 102-1. The temperature rise readings are denoted by multiple blocks, namely 302-1, 302-2 . . . 302-N, collectively referred to as temperature blocks 302 hereinafter.

An initial input temperature T0 recorded by the temperature sensor 102-1 at the start of the detection process is first loaded in the temperature block 302-1 of the input layer. The temperature sensor 102-1 senses and stores temperature readings at a pre-determined time interval, for example every minute. The temperature sensor then periodically sends the temperature readings to the classifier module 212, for example, every three minutes. These temperature readings are denoted as T1, T2 . . . TN in the temperature blocks 302. Each temperature block thus represents the rise in the temperature with respect to the previous temperature readings. The resultant temperature rise rate values received from each temperature block are sent to corresponding nodes, for example, Node 1, Node 2 . . . Node N, where the values are stored for future reference.

The temperature rise rates over different time intervals are then classified, for example given a score Ts 304, which lies between 0 and 1, using a temperature curve. In accordance with the present invention, the temperature curve can be developed by the neural network 300 based on training and learning acquired from historical data.

Figure 4A:
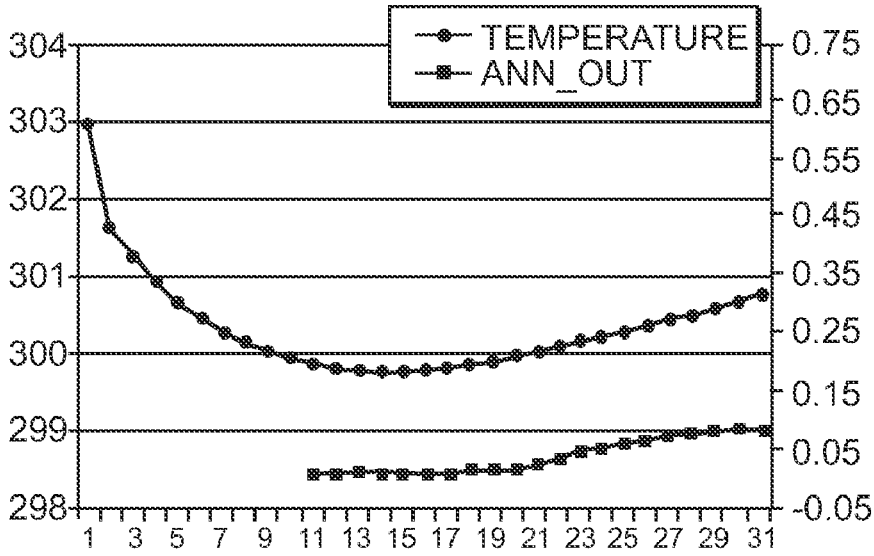
FIGS. 4*a*-4*b* show exemplary graphs for the classification of temperature rise rates and assignment of a numerical value in a range between zero and one, in accordance with an exemplary embodiment of the present invention.
Figure 4B:
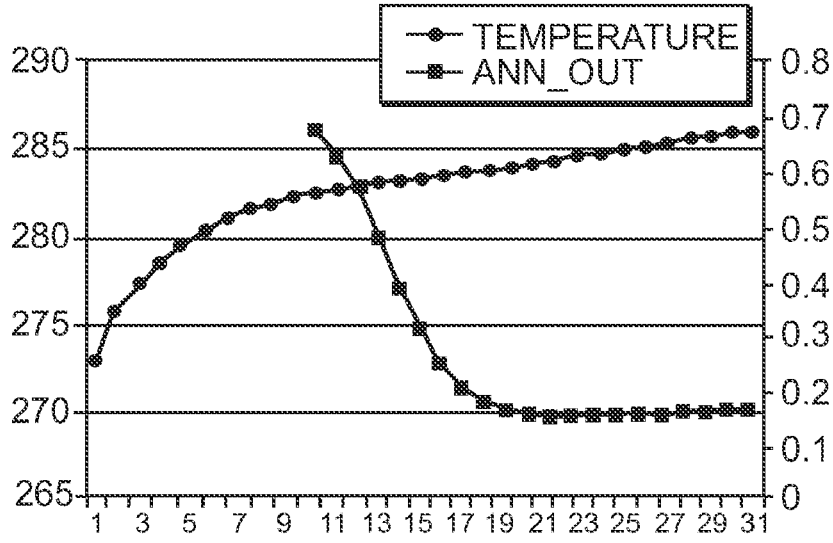

FIG. 4*b* shows an exemplary temperature curve 400 used by the neural network of the classifier module 212 to classify temperature rise rates in a range of 0 to 1. The temperature curve 400 includes two plots, 402 and 404, that correspond to the temperature readings received from a temperature sensor, such as sensor 102-1, and the classification of the temperature rise rate, respectively.

In the exemplary embodiment, which utilizes the temperature curve of FIG. 4*b*, the plot 402 represents the temperature readings received from a sensor 102-1, which recorded the readings every two minutes. As shown by 402, there is a steep rise in temperature initially and then a gradual linear rise in temperature.

Plot 404 represents the classification of temperature rise rates determined for every five minutes from the received temperature readings represented by 402. Thus 404 shows an initial high classification value of approximately 0.7, indicating an initial high temperature rise rate. The classification value then drops steeply to approximately 0.2 and thereafter becomes almost constant, indicating a low temperature rise rate.

Similar graphs illustrating other attributes of a fire as detected by sensors 102 can be plotted as a function of time. For example, the fire detection system can also include smoke sensors. A smoke sensor detects the amount of smoke present within a given perimeter and records multiple smoke concentration values. Each recorded value is converted into a corresponding digital voltage value. Further, the converted digital values can be classified based on the rise rate of the smoke concentration, which can also be used to determine a fire.

Figure 5:
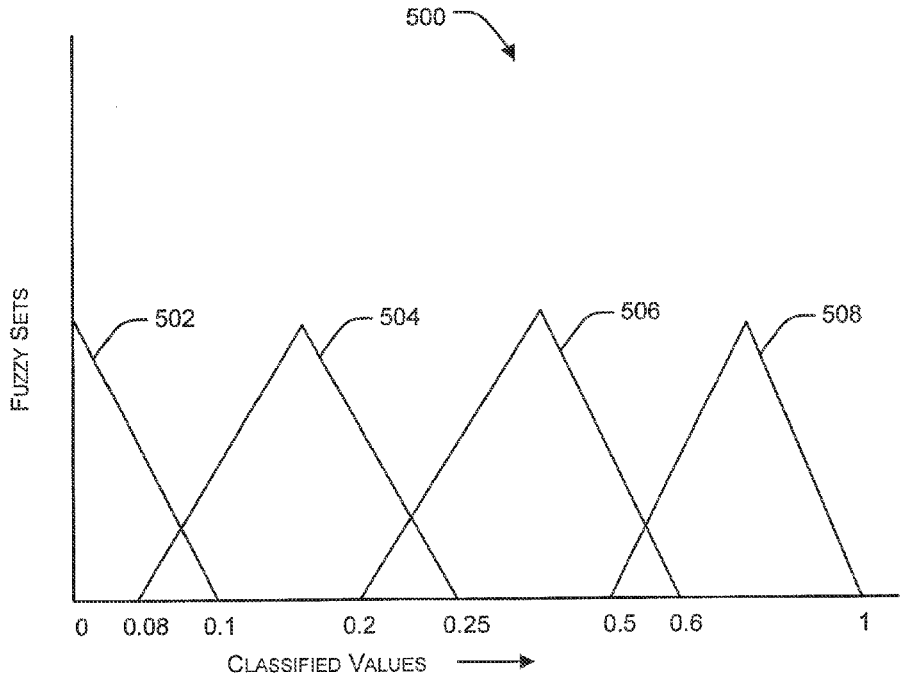
FIG. 5 shows an exemplary fuzzy set categorization for different temperature rise rates, in accordance with an exemplary embodiment of the present invention.

Further, the classification values generated by the classifier module 212 are used by the fuzzy inference module 106 to categorize the sensor inputs into fuzzy sets. FIG. 5 illustrates an exemplary fuzzy set categorization graph 500 that can be used by the fuzzy inference module 106 to categorize different classification values or sensor readings into fuzzy sets.

In one implementation, the X-axis represents the classification values of a fire attribute, for example, temperature rise rate, as received from the classifier module 212. The temperature rise rate can have, for example, four possible fuzzy sets namely, "null" (corresponding to a flat or negative temperature rise), "slow," "medium," and "fast", which correspond to plots 502, 504, 506, and 508, respectively. Each of these fuzzy sets is assigned a range of classification values. For example, the "null" set shown by 502 is assigned a range of 0.0-0.1, the "slow" set shown by 504 is assigned a range of 0.8-0.25, the "medium" set shown by 506 is assigned a range of 0.2-0.6, and the "fast" set shown by 508 is assigned a range of 0.5-1.0.

A temperature rise rate classification value received by the fuzzy inference module 106 is categorized under said fuzzy sets based on the range in which the value lies. For this, the classification value can be first given a membership level of 0 or 1 for each fuzzy set based on whether the value lies in the fuzzy set or not. For example, if the classification value is 0.06, then the value is given a membership level of 1 for the fuzzy set "null" and 0 for the rest of the fuzzy sets. In another example, a classification value of 0.225 is given a membership level of 1 in both the "slow" and "medium" sets since it lies within the "slow" and within the "medium" set.

The membership levels can be passed to a random number generator and a final set categorization can be assigned to each temperature rise rate classification value. For example, after processing by the random number generator, if the classification value has a 0.9 level in the "slow" and a 0.1 level in the "medium" set, there is a 90% probability that the input will be placed in the "slow" set.

Similarly, each of the sensor readings can also be categorized into different fuzzy sets based on fuzzy categorization limits, as shown in FIG. 6.

FIG. 6 is an exemplary table illustrating fuzzy categorization limits for different fire attributes, which can be used by the fuzzy inference module 106 to categorize readings from the sensors 102.

The first column 602 of the table provides fuzzy sets for different fire attributes measured by the sensors 102 along with their categories, for example, null, alert, and alarm levels of temperature, smoke, and CO readings. The different attributes may thus correspond to, temperature measured in Kelvin (degree K), carbon monoxide concentration measured in parts per million (ppm), and smoke concentration measured in percentage (%) of obscuration.

Column 604, termed as "Low Value", shows the lower limit or threshold levels of the fuzzy sets mentioned in Column 602. Column 606, termed as "Centre Value", presents central values of the fuzzy sets mentioned in Column 602. Column 608, termed as "High Value", indicates the higher limit of the fuzzy sets mentioned in Column 602.

Thus, a temperature reading of 400 degrees K. will be categorized under the "temperature alarm" fuzzy set. In another example, a smoke obscuration reading of 6% will be assigned to the "smoke alert 1" fuzzy set category. The fuzzy inference module 106 can thus categorize various inputs received from the classifier module 212 and the sensors 102 into different fuzzy sets. The fuzzy inference module 106 then combines the outputs of all the fuzzy categorizations and can assign an output of, for example 0 for no fire, 1 for possible incipient fire, or 2 for fire detected based on the combined memberships of the fuzzy sets. For example, a "smoke_alarm" output from the smoke sensor reading categorization by itself may not be sufficient to cause an alarm. However, a "smoke_alarm" output combined with either "CO_alert1," "CO_alert2," or "CO_alarm" or a "fast temperature rise" output can result in a 2 output and trigger, for example, an alarm 108.

By operating in such a way, the fire detection system 100 can effectively differentiate between a false fire and an actual fire situation, and can also detect fires of different types, such as a slow smoldering fire or a fast raging fire.

It can be understood that the above described fire detection system may have more than one sensor operating at a given time. The decision to raise an alarm may be a based on identifying a single fire attribute or on a combination of two or more different sensor recorded variables, which ever is appropriate, and on the application of a fuzzy inference on the identified measured variables.

Figure 7:
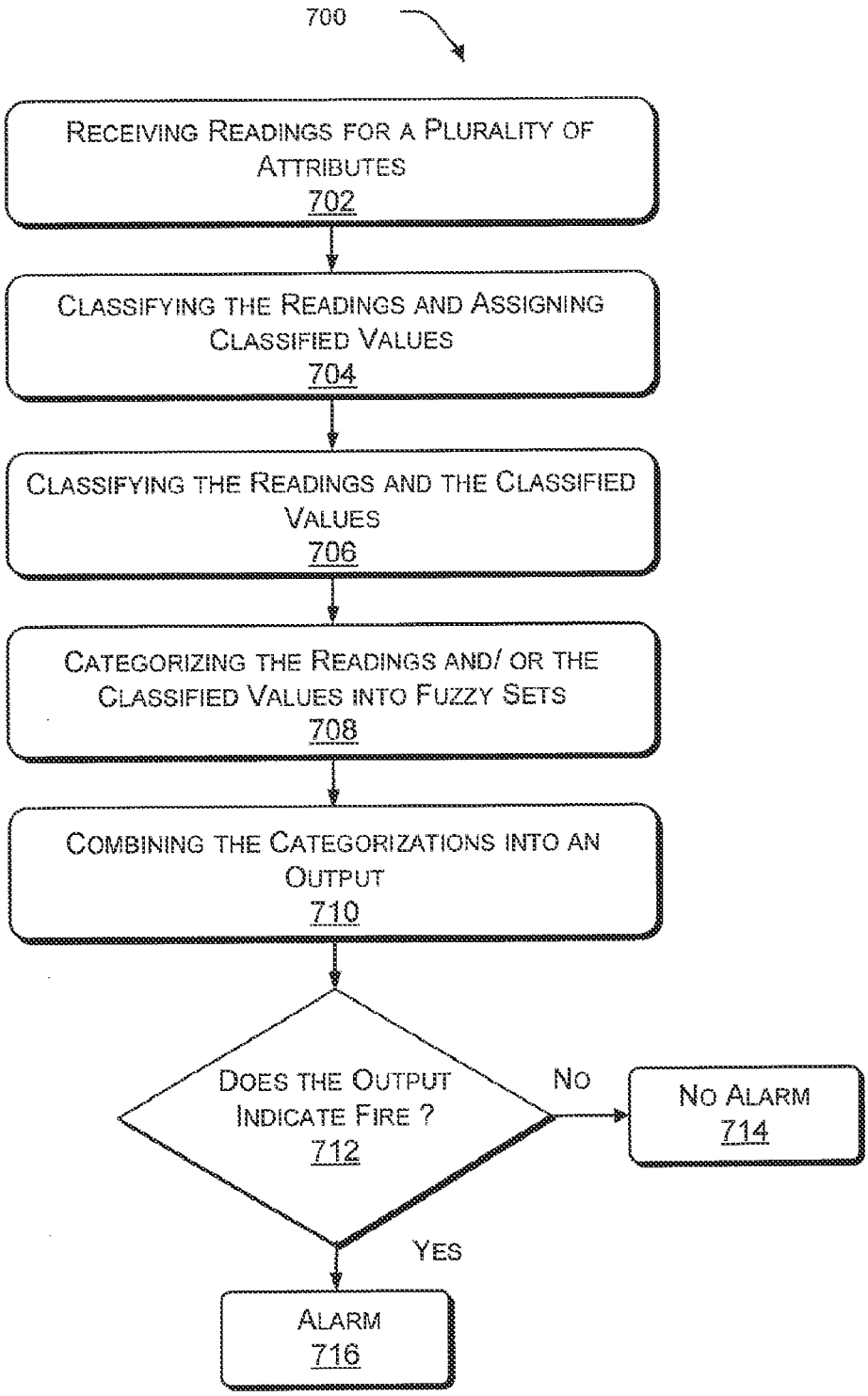
FIG. 7 shows an exemplary method for the detection of fire, in accordance with an exemplary embodiment of the present invention.

FIG. 7 illustrates an exemplary method 700 for detecting a fire. The method 700 is illustrated as a collection of blocks in a logical flow diagram, which represents a sequence of operations that can be implemented in hardware, software, or a combination thereof. In the context of software, the blocks represent computer instructions that, when executed by one or more processors, perform the recited operations. The order in which the method is described is not intended to be construed as a limitation, and any number of the described blocks can be combined in any order to implement the process, or an alternate process. Additionally, individual blocks may be deleted from the method without departing from the spirit and scope of the subject matter described herein.

At block 702, readings for a plurality of attributes related to fire detection are received. In one implementation, the sensors 102 including one or more of temperature sensors, smoke sensors, and carbon monoxide sensors send readings to the detection device 104. The measured variables may, for example, thus be temperature, percentage of obscuration due to smoke, and carbon monoxide (CO) concentrations.

Temperature sensors can provide periodic temperature readings of a location. For example, temperature may be measured twice per minute and the readings may be stored by a temperature sensor and transmitted at, say, every five minutes. In another example, the temperature sensor may transmit the readings as and when the readings are taken.

Smoke sensors sense the smoke concentration inside a premises by measuring the percentage obscuration due to smoke in terms of a voltage value. In one implementation, the voltage value is converted into a digital value and then sent to the detection device 104. Similarly, a CO sensor can provide CO concentration readings. For example, a CO sensor can use a heated tin oxide (Sn02) element, which may be initially calibrated to 100 ppm CO, may also be calibrated periodically to correlate the amount of decreased resistance over time with CO concentration.

At block 704, the readings are classified and classification values are assigned to each reading. In one implementation, the classifier module 212 in the detection device 104 classifies readings and assigns classification values to each reading using a multilayer perceptron neural network, such as the neural network 300. For example, temperature readings may be classified as per the temperature rise rates and a classification value between 0 and 1 may be assigned to the rise rates. A low rise rate may be assigned a low score and a high rise rate may be assigned a high score.

At block 706, the classification values and/or the readings are categorized into fuzzy sets. In one implementation, a fuzzy inference module 106 in the detection device 104 may categorize inputs including either the readings or the classification values, or both, into fuzzy sets as explained earlier with reference to FIGS. 5 and 6. For this, a membership value can be first assigned to each input and accordingly an input can be grouped in an appropriate fuzzy set based on limits associated with each of the fuzzy sets. Using a random number generator, a categorization can be then finalized for each input. For example, a temperature rise rate classification value of 0.7 is given a membership level of 1 for a "high temperature rise rate" fuzzy set, but a membership level of zero in all other sets. Therefore, the classification value of 0.7 is categorized as a member of the "high temperature rise rate" fuzzy set.

At block 710, the categorizations for the various inputs are combined into an output. The output can indicate "no fire", "possible fire" or "fire". For example, if at a given time, the fuzzy inference module 106 in the detection device 104 determines that the fuzzy categorizations are "smoke_alert", "carbon monoxide_null" and "temperature rise rate_null", the fuzzy inference module 106 can combine these categorizations to generate an output indication corresponding to "no fire". In another example, if the fuzzy categorizations are "smoke_alert", "carbon monoxide_alert" and "temperature rise rate_high", the fuzzy inference module 106 can combine these categorizations to generate an output indication corresponding to "fire". The output indication is thus based on a combination of inputs from the plurality of sensors 102 that has been analyzed by the detection device 104 using fuzzy sets to detect a fire.

At block 712, it is determined whether the output indicates a fire has been detected. For example, if the output corresponds to either "possible fire" or "fire", the fuzzy inference module 106 determines that a fire situation has been detected.

If a fire situation is not indicated, then the process proceeds to block 714 and no alarm or alternate counter-measure is triggered. If a fire situation is indicated, then the process proceeds from block 712 to block 716.

At block 714, an alarm will not be raised. In one implementation, if the combined output generated by the fuzzy inference module 106 from the classification values and the readings of the sensors 102 fall within a range of "no fire" then no alarm will be raised. At block 716, an alarm will be raised. For example, if the combined output generated by the fuzzy inference module 106 from the classification values and the readings of the sensors 102 indicates "fire", a signal is sent to the alarm 108 and an alarm is raised to alert the occupants of the particular location.

Though the above method has been discussed in the context of fire detection, it will be understood that a similar method in which readings are received from a plurality of sensors and are analyzed by a detection device using fuzzy inference, can be used to detect other hazardous conditions as well. For example, leakage of toxic gases can be detected using sensors that can assess the presence of and measure levels of various toxic fumes, and a detection device can use fuzzy inference to determine whether the seriousness of gas leakage warrants triggering of further action.

Using one or more temperature sensors and a neural network as a temperature detector, in accordance with the present invention, reliable fire detection can be achieved. Detectors using temperature for fire detection are governed by United Laboratories Standard, UL 521. Normal heat-detecting fire detectors trigger an alarm when a very rapid rate-of-rise of 15° F./min is measured. Such a rapid temperature rise is likely to be due to a fire, however, a fire large enough to cause a rapid temperature rise of this magnitude may well already too large for safe escape of any occupants. The distance between the fire and the sensor contributes to the short-comings of traditional heat based fire detectors. A small fire close to the detector may give readings like a larger fire at a greater distance from the detector.

Rather than triggering a fire at a rise rate of 15° F./min, the invention classifies the temperature rise rate and gives a score between 0 and 1 of the temperature rise rate. Low scores mean low rise rates, and high scores mean high rise rates. In accordance with one embodiment, the detector classifies temperature rises using a trained multi-layer-perceptron neural network. Temperature is measured, in accordance with one exemplary embodiment, and stored twice per minute. The stored temperatures from the previous five minutes, for example, are then loaded into the inputs of a temperature curve neural network. The neural network is shown in FIG. 3. The temperature classifier neural network works well in detecting temperature rises. FIGS. 4*a* and 4*b* show how the neural network detects slow and fast-rising temperatures, respectively. The output of the temperature classifier is sent to the Fuzzy Inference Module 106, FIG. 2, to decide whether or not there a fire is present.

While specific alternatives to steps of the invention have been described herein, additional alternatives not specifically disclosed but known in the art are intended to fall within the scope of the invention. Thus, it is understood that other applications of the present invention will be apparent to those skilled in the art upon reading the described embodiment and after consideration of the appended claims and drawing.

What is claimed is:

1. A hazard detection system, the system comprising:

a plurality of sensors configured to measure attributes associated with a hazard and generate sensor readings; and a detection device configured to determine whether the hazard exists or not based on a fuzzy analysis of the sensor readings, wherein:

the sensor readings include temperature readings: and the fuzzy analysis comprises:

determining a temperature rise rate from the temperature readings;

classifying the temperature rise rate by assigning a classification value in the range 0 to 1;

categorizing the temperature rise rate and the temperature readings into respective fuzzy set categories; and combining the respective fuzzy set categories into an output that indicates whether the hazardous condition exists or not.

2. The system of claim 1, wherein:

the attributes include one or more of temperature values, temperature rise rates, smoke concentrations and carbon monoxide (CO) concentrations; and the plurality of sensors include one or more of temperature sensors, smoke sensors, CO sensors and infrared sensors.

3. The system of claim 2, wherein:

the smoke sensor is an ionization smoke sensor configured to measure percentage obscuration due to smoke.

4. The system of claim 2, wherein:

the carbon monoxide (CO) sensor is a tin oxide element based sensor configured to measure CO concentration.

5. The system of claim 1, wherein:

the detection device comprises a fuzzy inference module configured to:

assign fuzzy set categories to the sensor readings; and combine the fuzzy set categories into an output indicating whether the hazard exists or not.

6. The system of claim 1, wherein:

the detection device comprises a classifier module configured to assign classification values to the sensor readings using a neural network, wherein the classification values lie in a range of 0 to 1.

7. The system of claim 6, wherein:

the detection device further comprises a fuzzy inference module configured to:

assign fuzzy set categories to the sensor readings and the classification values; and combine the fuzzy set categories into an output indicating whether the hazard exists or not.

8. The system of claim 1, wherein:

the detection device is further configured to raise an alarm if the hazard exists.

9. The system of claim 1, wherein:

the hazard is either a fire or a gas leak.

10. A method for detecting a hazardous condition, the method comprising:

receiving sensor readings from a plurality of sensors for attributes related to the hazardous condition; and determining whether the hazardous condition exists based on a fuzzy analysis of the sensor readings, wherein:

the sensor readings include temperature readings: and the fuzzy analysis comprises:

determining a temperature rise rate from the temperature readings;

classifying the temperature rise rate by assigning a classification value in the range 0 to 1;

categorizing the temperature rise rate and the temperature readings into respective fuzzy set categories; and combining the respective fuzzy set categories into an output that indicates whether the hazardous condition exists or not.

11. The method of claim 10, wherein:

the plurality of sensors includes one or more of temperature sensors, smoke sensors, carbon monoxide sensors and infrared sensors.

12. The method of claim 10, wherein:

the sensor readings include one or more of temperature readings, percentage smoke obscuration readings and carbon monoxide (CO) concentration values.

13. The method of claim 10, wherein the fuzzy analysis comprises:

categorizing the sensor readings into fuzzy set categories; and combining the fuzzy set categories into an output that indicates whether the hazardous condition exists or not.

14. The method of claim 10, wherein:

the hazardous condition is either a fire or a gas leak.

15. A device for detecting a fire, the device comprising:

a fuzzy inference module configured to receive classification values and sensor readings corresponding to a plurality of sensors that measure one or more fire related attributes, to categorize the classification values and the sensor readings into fuzzy set categories, and, wherein:

the sensor readings include temperature readings; and wherein, the fuzzy inference module is configured to:

determine a temperature rise rate from the temperature readings;

classify the temperature rise rate by assigning a classification value in the range 0 to 1;

categorize the temperature rise rate and the temperature readings into respective fuzzy set categories; and combine the respective fuzzy set categories into an output that indicates whether the hazardous condition exists or not.

16. The device according to claim 15 further comprising:

a classifier module configured to assign the classification values using a neural network, wherein the classification values lie in the range of 0 to 1.

17. The device according to claim 15, wherein:

the plurality of sensors includes one or more of temperature sensors, smoke sensors, carbon monoxide sensors and infrared sensors.

18. The device according to claim 15, wherein:

the fuzzy inference module triggers an alarm or another remedy if the fire exists.

19. The device of claim 15, wherein the categorizing comprises:

assigning membership levels for one or more fuzzy set categories to the classification value;

determining a probability of the classification value belonging to the one or more fuzzy set categories; and categorizing the classification value into a fuzzy set category for which the classification value has the highest probability.

* * * * *